US006170763B1

(12) United States Patent
Fuchs et al.

(10) Patent No.: US 6,170,763 B1
(45) Date of Patent: Jan. 9, 2001

(54) FUEL INJECTION VALVE

(75) Inventors: Heinz Fuchs, Stuttgart; Günter Dantes, Eberdingen; Jörg Heyse, Markgröningen, all of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/155,455

(22) PCT Filed: Nov. 19, 1997

(86) PCT No.: PCT/DE97/02706

§ 371 Date: Sep. 29, 1998

§ 102(e) Date: Sep. 29, 1998

(87) PCT Pub. No.: WO98/34026

PCT Pub. Date: Aug. 6, 1998

(30) Foreign Application Priority Data

Jan. 30, 1997 (DE) ..... 197 03 200

(51) Int. Cl.[7] ..... F02M 61/00; B05B 1/34

(52) U.S. Cl. ..... 239/533.12; 239/533.11; 239/533.14; 239/585.1; 239/596; 239/601; 239/900

(58) Field of Search ..... 239/533.3, 533.11, 239/533.12, 533.14, 585.1, 585.2, 585.3, 585.4, 585.5, 596, 601, 900

(56) References Cited

U.S. PATENT DOCUMENTS

| | | | | |
|---|---|---|---|---|
| 4,699,323 | | 10/1987 | Rush et al. . | |
| 4,925,111 | | 5/1990 | Foertsch et al. . | |
| 5,402,937 | * | 4/1995 | Buchholz et al. | 239/585.5 X |
| 5,636,796 | * | 6/1997 | Oguma | 239/533.12 |
| 5,766,441 | * | 6/1998 | Arndt et al. | 239/596 X |
| 5,899,390 | * | 5/1999 | Arndt et al. | 239/596 X |
| 5,924,634 | * | 7/1999 | Arndt et al. | 239/596 X |

FOREIGN PATENT DOCUMENTS

| | | | | |
|---|---|---|---|---|
| 38 08 396 | | 9/1989 | (DE) . | |
| 41 21 310 | | 1/1992 | (DE) . | |
| 196 07 277 | | 10/1996 | (DE) . | |
| 19527626 | * | 1/1997 | (DE) | 239/585.1 |
| 0 310 819 | | 4/1989 | (EP) . | |
| 97 05378 | | 2/1997 | (WO) . | |

* cited by examiner

*Primary Examiner*—James Hook
*Assistant Examiner*—Robin O. Evans
(74) *Attorney, Agent, or Firm*—Kenyon & Kenyon

(57) ABSTRACT

A fuel inject includes an orifice plate which is arranged on a valve-seat member, particularly at its downstream end face, the valve-seat member having a fixed valve seat, the orifice geometry of the orifice plate being bounded by the valve-seat member, so that the flow ratios in the orifice plate are influenced by the valve-seat member. The valve-seat member covers an upper inlet region of the orifice plate, at least to the extent that downstream outlet orifices of the orifice plate are overlapped. The fuel injector is particularly suited for use in fuel systems of mixture-compressing internal combustion engines with externally supplied ignition.

9 Claims, 8 Drawing Sheets

FUEL INJECTION VALVE

BACKGROUND INFORMATION

German Patent Application No. 41 21 310 describes a fuel injector which has a valve-seat member on which a fixed valve seat is formed. A valve-closure member, axially movable in the injector, interacts with this valve seat formed in the valve-seat member. Contiguous to the valve-seat member in the downstream direction is a flat jet-aligning plate, in which, facing the valve seat, provision is made for an H-shaped depression as an inlet area. Contiguous to the H-shaped inlet area in the downstream direction are four spray-discharge orifices, so that a fuel to be sprayed can be distributed via the inlet area right up to the spray-discharge orifices. In this case, the flow geometry in the jet-aligning plate is not intended to be influenced by the valve-seat member. Rather, a flow passage downstream of the valve seat in the valve-seat member is designed to be so wide, that the valve-seat member has no influence on the orifice geometry of the jet-aligning plate.

A lack of influence of the valve-seat member on the orifice geometry of an orifice plate arranged at a fuel injector applies also to fuel injectors which are described in U.S. Pat. No. 4,699,323 or in European Patent No. 0 310 819. In these patents, the orifice plates have functional planes with different orifice geometries; however, an overlap of the inlet areas of the spray orifices in the orifice plate by the valve-seat member is in no way desired or allowed.

German Patent Application No. 196 07 277 describes a fuel injector having an orifice plate which has a plurality of functional planes exhibiting different orifice geometries. The individual functional planes of the orifice plate are built up on one another by galvanic metal deposition (multilayer electroplating). In this injector as well, the valve-seat member should never limit or overlap the inlet openings in the upper functional level of the orifice plate.

SUMMARY OF THE INVENTION

The fuel injector of the present invention, has the advantage that a uniform, very fine atomization of the fuel is achieved in a simple manner without additional energy, a particularly high atomization quality and a jet formation adapted to the respective requirements being attained. This is achieved in that an orifice plate arranged downstream of a valve seat has an orifice geometry for a complete axial passage of the fuel, the orifice geometry being bounded by a valve-seat member surrounding the fixed valve seat. Thus, the valve-seat member already assumes the function of influencing the flow in the orifice plate, which in the conventional orifice plates, could be achieved by their upper layers or functional planes. In another embodiment of the present invention, an S-course is attained in the flow for improving the fuel atomization, since the valve-seat member, with a lower end face, overlaps the outlet orifices of the orifice plate.

The S-course in the flow attained by the geometrical arrangement of the valve-seat member and the orifice plate allows the formation of bizarre jet shapes with a high atomization quality. The orifice plates, in conjunction with appropriately designed valve-seat members, render possible jet cross-sections for single, double and multi-jet sprays in countless variants, such as rectangles, triangles, crosses and ellipses. Such unusual jet shapes permit a precise, optimal adaptation to predetermined geometries, e.g. to various intake-manifold cross-sections of internal combustion engines. The advantages resulting from this are a shape-adapted utilization of the available cross-section for the homogeneously distributed, exhaust-decreasing introduction of the mixture, and avoidance of exhaust-harmful film accumulations on the wall of the intake manifold. Consequently, such a fuel injector can reduce the exhaust-gas emission of the internal combustion engine, and fuel consumption can likewise be reduced.

With the assistance of galvanic metal deposition, orifice plates can be simultaneously produced in very large quantities in a reproducible manner with extreme precision and cost-effectively. Furthermore, this manner of manufacturing allows extremely great freedom in shaping, since the contours of the orifices in the orifice plate are freely selectable. Particularly in comparison to silicon orifice plates, in which the attainable contours are strictly predefined because of the crystal axes (truncated pyramids), flexible shaping is advantageous. Metallic deposition, especially compared to the manufacture of silicon disks, offers the advantage of a very large variety of materials. The most varied metals with their different magnetic properties and hardness can be used in manufacturing the orifice plates.

It is advantageous to form the orifice plates with two functional planes, one functional plane being characterized by an orifice geometry which, viewed across its axial thickness, is constant, the orifice geometry differing suitably from the orifice geometry of the subsequent functional plane. Since the valve-seat member ultimately determines the inlet geometry into the orifice plate, two functional planes are already sufficient for attaining an S-shaped flow. Compared to multilayer or multilayered orifice plates, the advantages of a simpler, less costly and timereduced manufacture result, since on one hand, less metallic material has to be deposited, and on the other hand, it is possible to dispense with electroplating starting layers. Furthermore, the photoresist can be removed substantially more easily. In addition, accuracy can be better controlled when producing the orifice plates, because all the orifice contours of the orifice plate can be examined from an outer end face.

Quite generally, it can be stressed as an advantage of the fuel injector of the present invention, that it is possible to vary the jet pattern in a simple manner. Thus jet patterns which are flat, conical, which include a plurality of individual jets, and which are asymmetrical (directed on one side) can be generated particularly easily.

DETAILED DESCRIPTION

Figure 1:
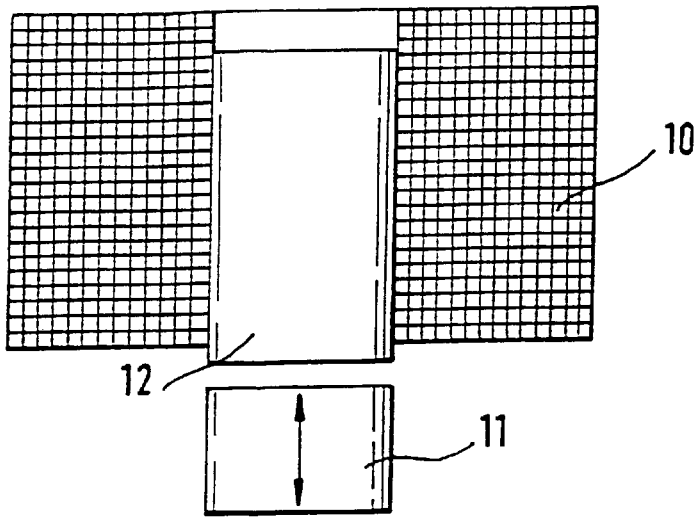
FIG. 1 shows a partially depicted injector illustrating a first embodiment of an orifice plate downstream of a valve-seat member.
Figure 1:
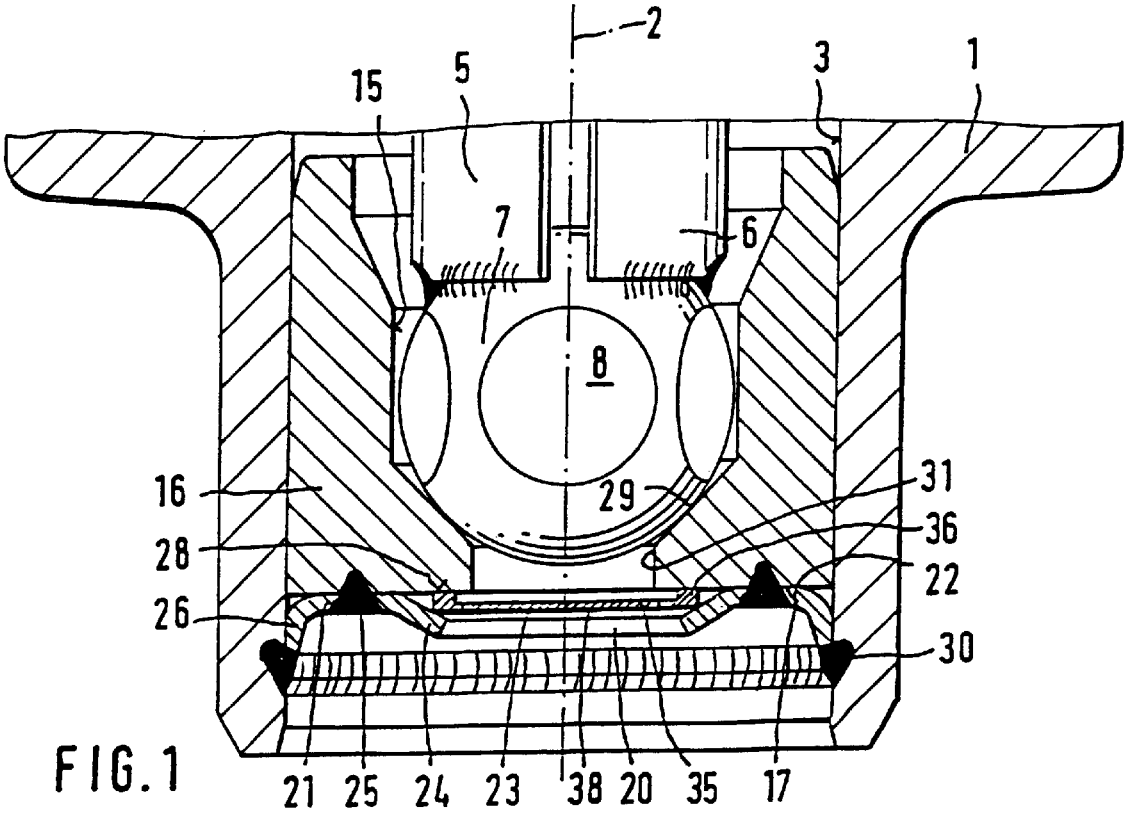

Partially depicted as an exemplary embodiment in FIG. 1 is a valve in the form of an injector for fuel-injection systems of mixture-compressing internal combustion engines with externally supplied ignition. The injector has a tubular valve-seat support 1, in which is formed a longitudinal opening 3 concentrically to a longitudinal valve axis 2. Arranged in longitudinal opening 3 is a, for example, tubular valve needle 5 which at its downstream end 6 is firmly joined to a, for example, spherical valve-closure member 7, at whose periphery are provided, illustratively, five flattenings 8 for the flow-by of the fuel.

The injector is actuated in a known manner, e.g. electromagnetically. An electromagnetic circuit, indicated schematically, having a magnetic coil 10, an armature 11 and a core 12, is used for the axial movement of valve needle 5, and thus for opening the injector against the spring tension of a resetting spring, not shown, or for closing the injector. Armature 11 is joined to the end of valve needle 5 facing away from valve-closure member 7 by, for example, a welded seam formed with the assistance of a laser, and is aligned with core 12.

Used to guide valve-closure member 7 during the axial movement is a guide opening 15 of a valve-seat member 16 which is imperviously mounted by welding in the downstream end, facing away from core 12, of valve-seat support 1 in longitudinal opening 3 running concentrically to longitudinal valve axis 2. At its lower end face 17, facing away from valve-closure member 7, valve-seat member 16 is concentrically and firmly joined to a, for example, pot-shaped orifice-plate support 21, which thus, with at least an outer annular area 22, abuts directly against valve-seat member 16. Orifice-plate support 21 exhibits a shape similar to pot-shaped apertured spray disks already known, a middle area of orifice-plate support 21 being provided with a feed-through opening 20 without metering function.

An orifice plate 23 is arranged upstream of feed-through opening 20 in such a way that it completely covers feed-through opening 20. Orifice plate 23 represents only an insertion part which is insertable into orifice-plate support 21. Orifice-plate support 21 is designed with a base part 24 and a retention rim 26. Retention rim 26 extends in the axial direction facing away from valve-seat member 16, and is curved outwardly, tapering to its end. Base part 24 is formed by outer annular area 22 and central feed-through opening 20.

Valve-seat member 16 and orifice-plate support 21 are joined, for example, by a circumferential continuous and impervious first welded seam 25, formed by a laser. This type of assembly obviates the danger of an unwanted deformation of orifice-plate support 21 in its middle area with feed-through opening 20 and orifice plate 23 arranged there upstream. Orifice-plate support 21 is furthermore joined in the area of retention rim 26 to the wall of longitudinal opening 3 in valve-seat support 1, e.g., by a circumferential and impervious second welded seam 30.

Orifice plate 23, which can be fastened in the area of feed-through hole 20 within circular welded seam 25 between orifice-plate support 21 and valve-seat member 16, abuts with an upper end face 28 against lower end face 17 of valve-seat member 16, so that within welded seam 25, base part 24 of orifice-plate support 21 lies removed with clearance from end face 17. Orifice plate 23 includes, e.g., two functional planes. In this context, one functional plane should in each case have a substantially constant opening contour over its axial extension, so that precisely the next functional plane exhibits a different opening contour.

The insertion depth of the valve-seat part, composed of valve-seat member 16, pot-shaped orifice-plate support 21 and orifice plate 23, into longitudinal opening 3 determines the extent of lift of valve needle 5, since the one end position of valve needle 5, when magnetic coil 10 is not excited, is established by the contact of valve-closure member 7 against a valve-seat surface 29 of valve-seat member 16 tapering downstream. The other end position of valve needle 5, when magnetic coil 10 is excited, is established, e.g., by the contact of armature 11 against core 12. Thus, the travel between these two end positions of valve-needle 5 represents the lift. Spherical valve-closure member 7 interacts with frustoconical valve-seat surface 29 of valve-seat member 16, the valve-seat surface 29 being formed in the axial direction between guide opening 15 and a lower cylindrical outlet 31 of valve-seat member 16, outlet 31 extending to end face 17.

Affixing orifice plate 23 to valve-seat member 16, using orifice-plate support 21 as the indirect attachment, means has the advantage that deformations conditional upon temperature, which could possibly occur in methods such as welding or soldering when attaching perforated-disk 23 directly, are avoided. However, orifice-plate support 21 by no means represents an exclusive condition for attaching orifice plate 23. Since the attachment possibilities are not essential for the present invention, reference is made here only to the customary known joining methods such as welding, soldering or bonding.

Orifice plates 23 shown in FIGS. 1 through 12 are built up in at least two metallic functional planes by electrodeposition. Because of the fabrication using depth lithography and electroplating techniques, special features result in the contouring, of which a few are summarized here:

- Functional planes having constant thickness over the disk surface;
- substantially vertical cuts in the functional planes due to the structuring using depth lithography, the cuts forming the cavities through which there is flow (deviations of about 3%, subject to production engineering, can occur compared to optimally vertical walls);
- desired undercuts and overlappings of the cuts due to multilayer build-up of individually structured metallic layers;
- cuts with any cross-sectional forms as desired, the cross-sectional forms having substantially axially-parallel walls;
- one-piece construction of the orifice plate, since the individual metal depositions are effected directly on one another.

In the following paragraphs, the method for producing orifice plates 23 according to FIGS. 1 through 12 is summarized. All the method steps of galvanic metal deposition for producing an orifice plate are described in German Patent Application No. 196 07 288. It is characteristic for the method of successive use of photolithographic steps (UV depth lithography) and subsequent micro-electroplating, that even in large-surface scale, it assures high precision of the structures, so that it is ideally applicable for mass production with very large quantities. A multitude of orifice plates 23 can be produced simultaneously on one wafer.

The starting point for the method is a flat and stable substrate board which can be made, e.g., of metal (titanium, copper), silicon, glass or ceramic. First of all, at least one auxiliary layer is electrodeposited onto the substrate board. For example, it is an electroplating starting layer (e.g. Cu), which is needed for the electrical conductance for the later micro-electroplating. The electroplating starting layer can also be used as a sacrificial layer, to later permit easy separation of the orifice-plate structures by etching. The auxiliary layer (typically CrCu or CrCuCr) is applied, e.g., by sputtering or by currentless metal deposition. After this pretreatment of the substrate board, a photoresist is applied on the auxiliary layer over the entire surface.

The thickness of the photoresist should correspond to the thickness of the metal layer, which is to be implemented in the electroplating process following later, thus to the thickness of the lower functional plane of orifice plate 23. The metal pattern to be produced should be transferred with the aid of a photolithographic mask inversely in the photoresist. A possibility exists of exposing the photoresist directly via the mask with the assistance of UV irradiation (UV depth lithography).

The negative pattern for the later functional plane of orifice plate 23, ultimately formed in the photoresist, is filled up galvanically with metal (e.g. Ni, NiCo)(metal deposition). Due to the electroplating, the metal intimately joins to the contour of the negative pattern, so that the preselected contours are reproduced in it true to form. To implement the pattern of orifice plate 23, the steps starting from the optional application of the auxiliary layer must be repeated in conformance with the number of axially successive orifice contours desired, it also being possible, for example, to produce the two functional planes of orifice plate 23 in one electroplating step. Advantageously, a further electroplating starting layer is not needed in the build-up of an orifice plate 23 including two functional planes. Finally, orifice plates 23 are separated. To that end, the sacrificial layer is etched away, whereby orifice plates 23 lift off from the substrate board. Thereupon, the remaining photoresist is dissolved out of the metal patterns.

Figure 2:
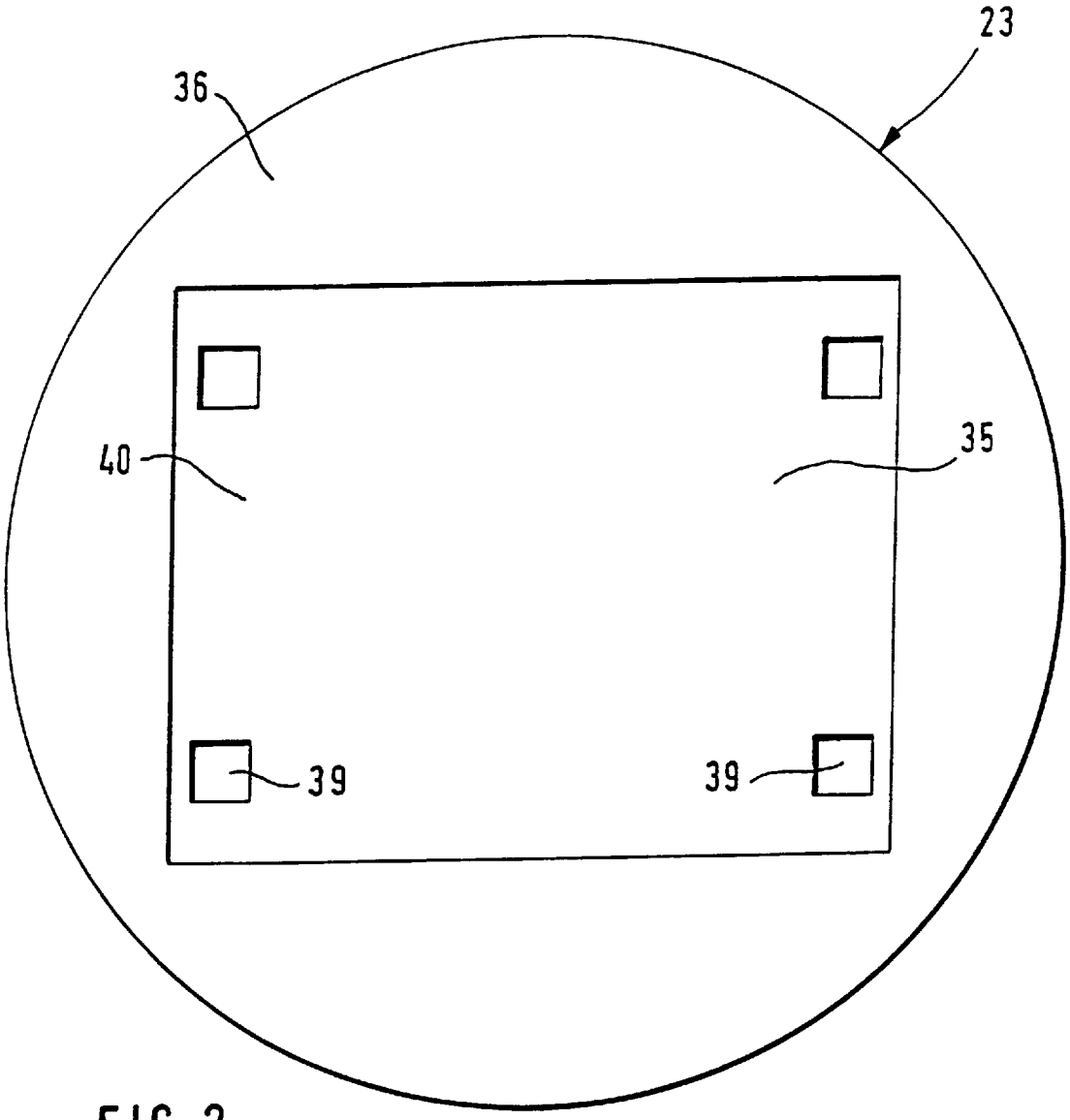
FIG. 2 shows a top view of the orifice plate illustrated in FIG. 1.

As a first exemplary embodiment of an orifice plate 23, FIG. 2 shows, in a top view, orifice plate 23 depicted in section in FIG. 1. Orifice plate 23 is designed as a flat, circular member that has at least two axially successive functional planes. A lower, first-deposited functional plane 35 has outlet orifices 39 whose size is defined by the micro-electroplating, while the micro-galvanically produced opening contour of an upper functional plane 36 is additionally influenced or bounded by valve-seat member 16. Both functional layers 35 and 36 are produced, e.g., in one electroplating step. Upper functional plane 36 exhibits an inlet region 40 that has a rectangular contour and, in the final analysis, represents a depression in orifice plate 23. Starting from inlet region 40, the four outlet orifices 39, for example, which are arranged near the four corner points of inlet region 40 and are designed with quadratic cross-sections, run through lower functional plane 35 to a lower end face 38 of orifice plate 23 (FIG. 1).

Valve-seat member 16 is shaped with its lower orifice 31 in such a way that lower end face 17 of valve-seat member 16 partially forms an upper covering of inlet region 40 of upper functional plane 36 of orifice plate 23, and thus establishes the entrance surface for the fuel into orifice plate 23. In the exemplary embodiment shown in FIG. 1, outlet 31 has a smaller diameter than the diameter of an assumed circle, upon which outlet orifices 39 of orifice plate 23 are located. In other words, a complete displacement exists between outlet 31 determining the inlet of orifice plate 23, and outlet orifices 39. Assuming a projection of valve-seat member 16 onto orifice plate 23, valve-seat member 16 covers all outlet orifices 39. An S-shaped flow of the medium, here the fuel, results because of the radial displacement of outlet orifices 39 with respect to outlet 31. An S-shaped flow is even already attained when valve-seat member 16 only partially covers all outlet orifices 39 in orifice plate 23.

Due to the "S-course" within orifice plate 23 exhibiting several sharp flow deflections, a strong, atomization-promoting turbulence is superimposed on the flow. The velocity gradient transverse to the flow motion is thereby especially strongly pronounced. It is an expression for the change in velocity transverse to the flow, the velocity in the middle of the flow being perceptibly greater than near the walls. The increased shear stresses in the fluid resulting from the velocity differences promote the disintegration into fine droplets near outlet orifices 39. Since the flow in the outlet is separated on one side because of the superimposed radial component, it is not calmed down because it lacks contour guidance. The fluid exhibits a particularly high velocity at the separated side. Thus, the atomization-promoting turbulence and shear stresses are not nullified in the outlet.

The result of the transverse pulses transverse to the flow motion, present because of the turbulence, is that, among other things, the density of the droplet distribution in the ejected spray exhibits a great uniformness. Resulting from this is a reduced probability of droplet coagulation, thus of smaller droplets combining to form larger drops. The effect of the advantageous reduction in the average droplet diameter in the spray is a relatively homogenous spray distribution. Due to the S-course, a fine-scale (high-frequency) turbulence is produced in the fluid, the turbulence allowing the jet to disintegrate into suitably fine droplets immediately after emerging from orifice plate 23.

Figure 3:
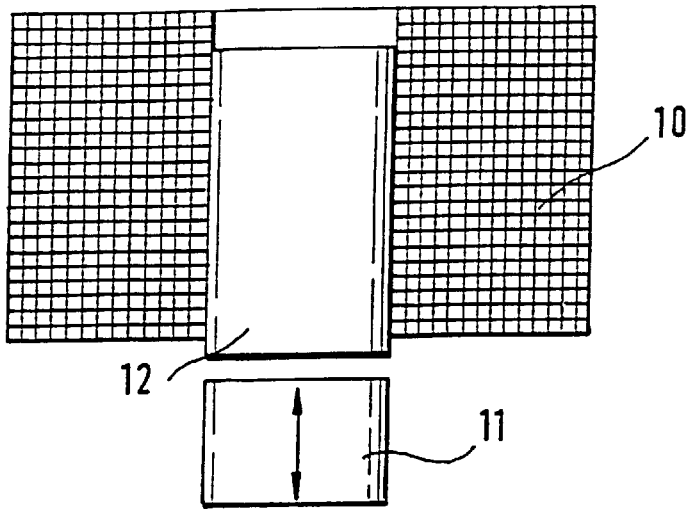
FIG. 3 shows another partially depicted injection valve illustrating a second embodiment of the orifice plate downstream of the valve-seat member.
Figure 3:
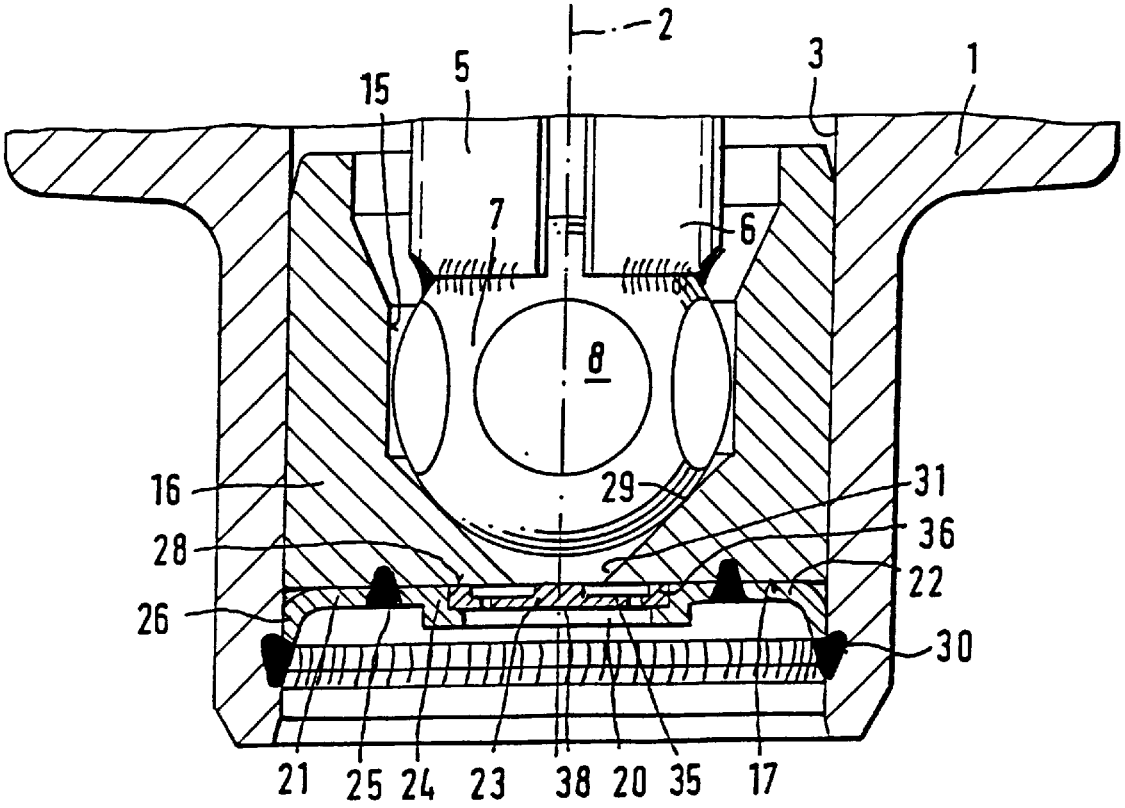

FIG. 3 shows a second exemplary embodiment of a partially depicted injector. The structural elements which are identical or equally-acting compared to the exemplary embodiment shown in FIG. 1 are indicated by the same reference numerals. The injector of FIG. 3 corresponds essentially to the injector of FIG. 1, which is why in the following, only the differing areas of outlet 31, orifice plate 23 and orifice-plate support 21 are explained more precisely. Outlet 31 now represents the extension of valve-seat surface 29, tapering frustoconically in the direction of flow, and therefore likewise has a frustoconical shape. Thus, no cylindrical area follows valve-seat surface 29 in the downstream direction.

Figure 4:
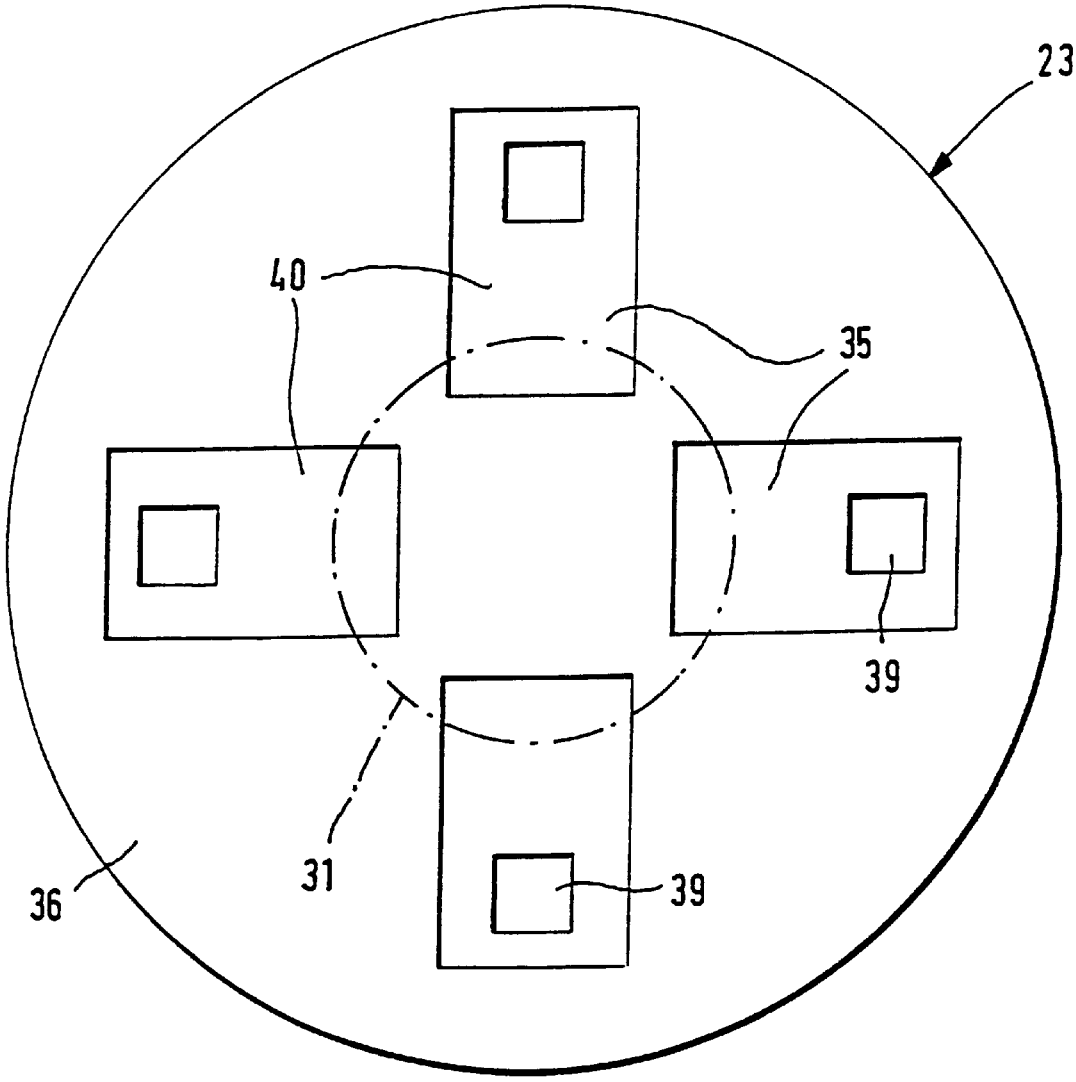
FIG. 4 shows a top view of the orifice plate illustrated in FIG. 3.

On the other hand, in this exemplary embodiment, orifice plate 23, having two functional planes 35 and 36, has four inlet regions 40 formed in upper functional plane 36, which can be seen illustratively from FIG. 4 as a top view of orifice plate 23. Valve-seat member 16, with its lower end face 17, again covers the four inlet regions 40 in such a way that a complete displacement results between outlet 31 and the four outlet orifices 39 formed in lower functional plane 35. The four inlet regions 40 are separated from each other by material regions of upper functional plane 36, the material regions being built up, starting from lower functional plane 35, by further micro-electrodeposition. Near feed-through opening 20, orifice-plate support 21 forms an angle, so that it reaches under orifice plate 23 at its outer edge with form accuracy, and can press against end face 17 of valve-seat member 16.

All the advantages of the displacement of outlet 31 and outlet orifices 39, as well as the S-course forming in the flow of the medium caused by this, already set forth for the exemplary embodiment according to FIGS. 1 and 2, are yielded in comparable manner for the exemplary embodiment according to FIGS. 3 and 4. FIG. 4 shows the arrangement of, for example, the four rectangular inlet regions 40. Viewed across circular orifice plate 23, inlet regions 40 are formed in each case to be positioned relative to each other by 90°, inlet regions 40 not contacting, since they are separated from one another by electrodeposited material regions of upper functional plane 36. At the same time, formed in the center of orifice plate 23 is a nearly quadratic material region, starting from which, the four inlet regions 40 extend radially outwardly. Starting from the radially outer sections of inlet regions 40, in each case one, thus altogether four outlet orifices 39, having, for example, quadratic cross-sections, run axially through lower functional plane 35 to lower end face 38 of orifice plate 23. Outlet 31 of valve-seat member 16 in the region of lower end face 17 is sketched symbolically with a dot-dash line in FIG. 4, for the purpose of illustrating the displacement with respect to outlet orifices 39.

FIGS. 5 to 12 show further exemplary embodiments of orifice plates 23 having two functional planes 35 and 36, the flow in the orifice plates, similarly to FIGS. 1 and 3, according to the present invention, being influenced by valve-seat member 16. Common to all the following exemplary embodiments of orifice plates 23 is that they have at least one inlet region 40 in upper functional plane 36, and at least one outlet orifice 39 in lower functional plane 35, inlet regions 40 in each case being so large with respect to their breadth or width, that all outlet orifices 39 are completely flowed over. By this is meant that no walls bounding inlet regions 40 cover outlet orifices 39. Following from this is that inlet regions 40 usually possess larger cross-sections than outlet orifices 39 starting from them.

Figure 5:
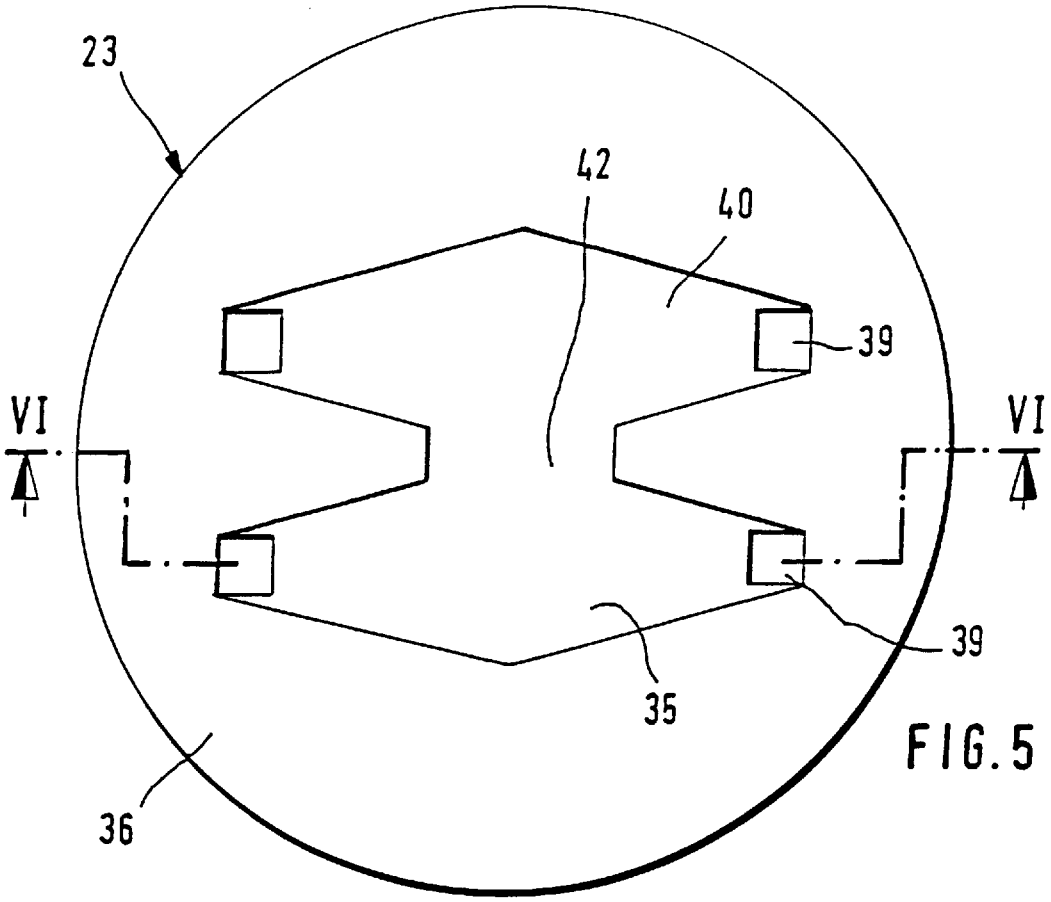
FIG. 5 shows a top view of a third embodiment of the orifice plate.
Figure 6:
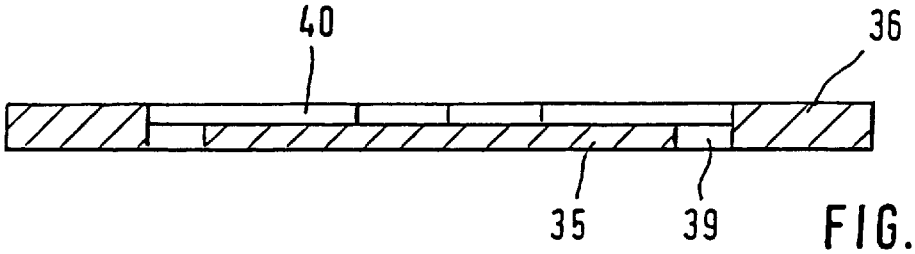
FIG. 6 shows the orifice plate in a section along the line VI—VI illustrated in FIG. 5.
Figure 7:
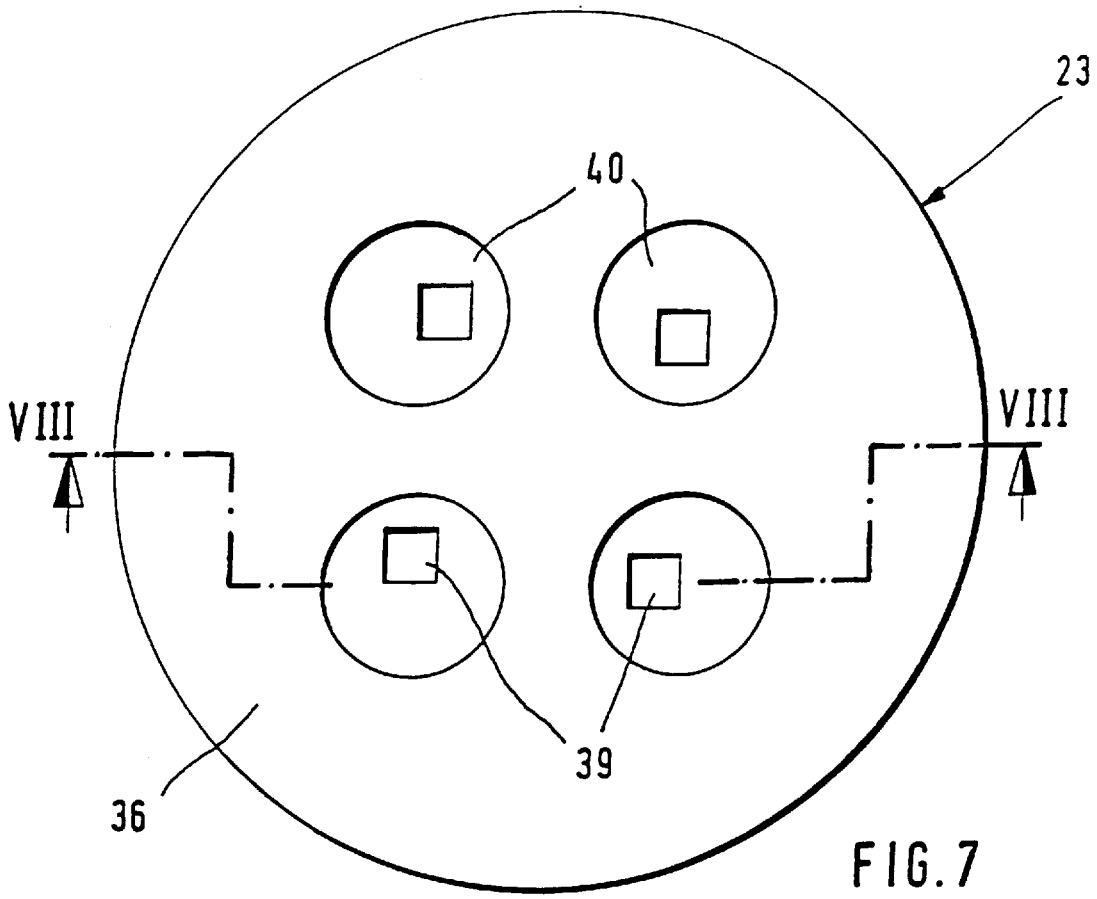
FIG. 7 shows a top view of a fourth embodiment of the orifice plate.
Figure 8:
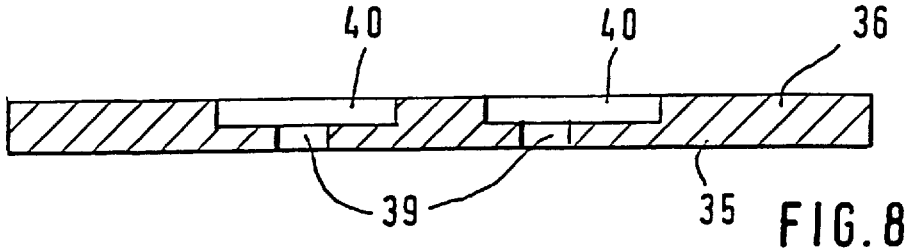
FIG. 8 shows the orifice plate in a section along the line VIII—VIII illustrated in FIG. 7.

In orifice plate 23 shown in FIGS. 5 and 6, inlet region 40 is designed in a shape similar to a double rhombus, the two rhombi being joined by a middle interconnecting region 42, so that only a single inlet region 40 is present. Starting from double-rhombus-shaped inlet region 40, four outlet orifices 39 having, e.g., quadratic cross-sections, run through lower functional plane 35, the outlet orifices, viewed from the center point of orifice plate 23, being formed, for example, at the most distant points of inlet region 40. Since the rhombi of inlet region 40 are relatively flat and elongated, two outlet orifices in each case form an orifice pair which is relatively far removed from the second orifice pair on the other side of orifice plate 23. Such an arrangement of outlet orifices 39 permits a dual-jet spray, or even a fan-jet spray if the orifice pairs are not quite so far distant from one another. FIG. 6 is a sectional view along a line VI—VI in FIG. 5.

Figure 9:
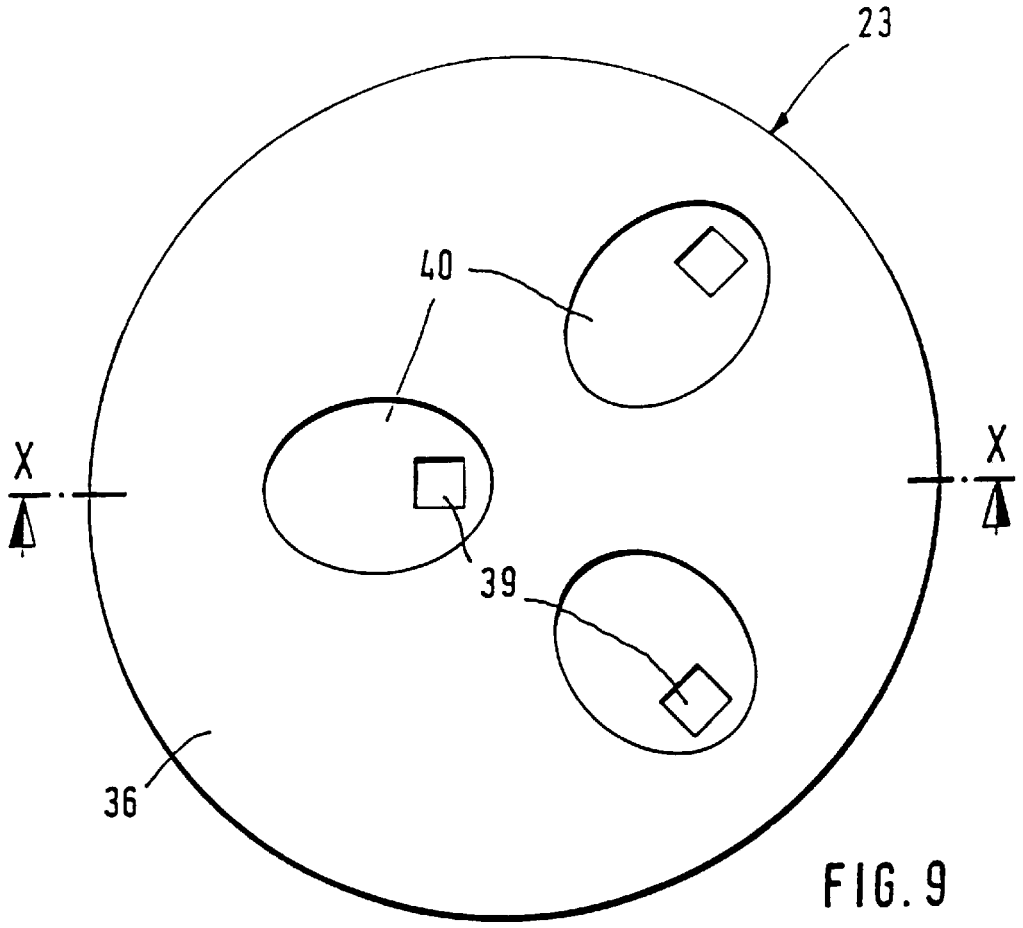
FIG. 9 shows a top view of a fifth embodiment of the orifice plate.
Figure 10:
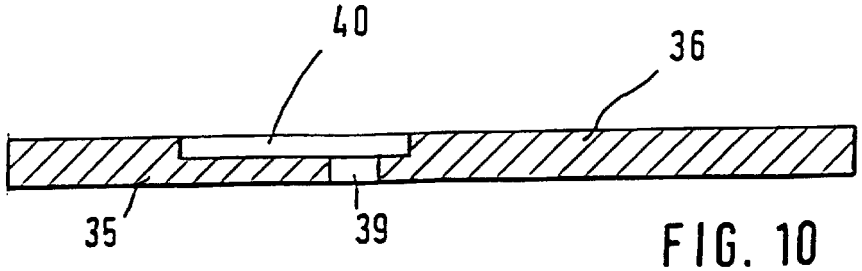
FIG. 10 shows the orifice plate in a section along the line X—X illustrated in FIG. 9.
Figure 11:
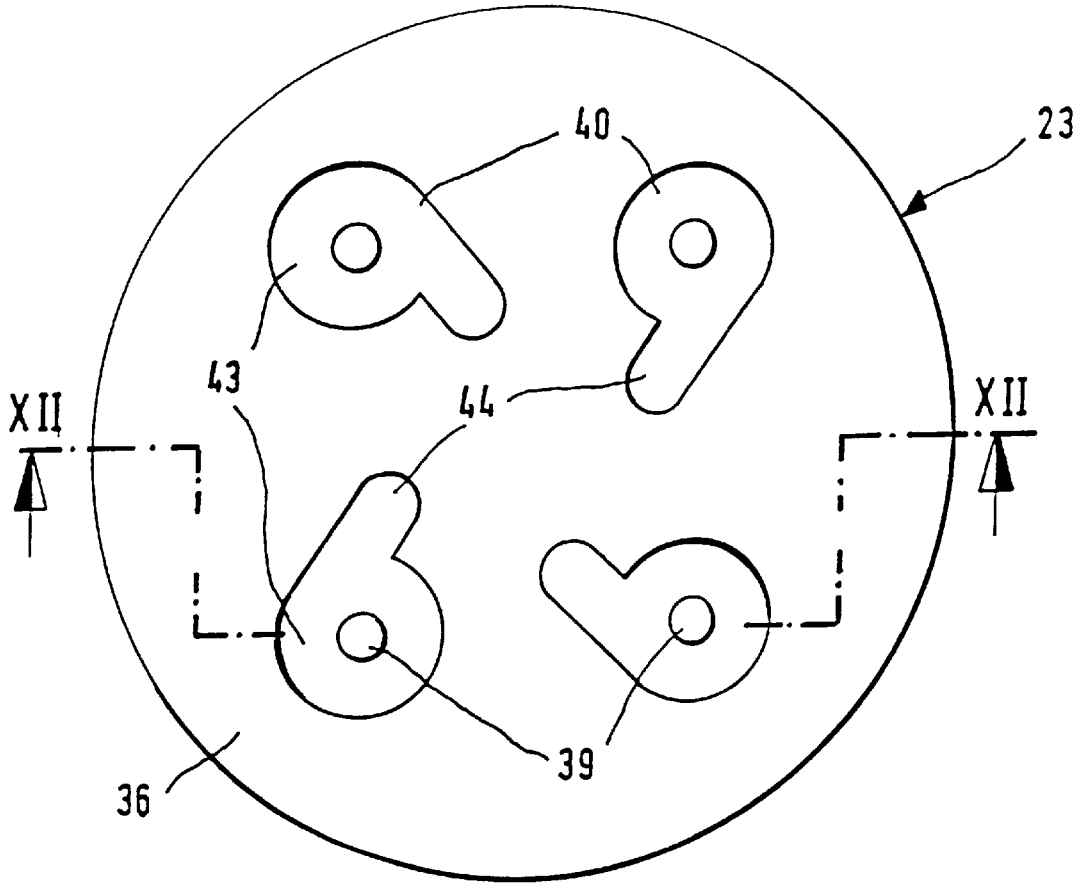
FIG. 11 shows a top view of a sixth embodiment of the orifice plate.
Figure 12:
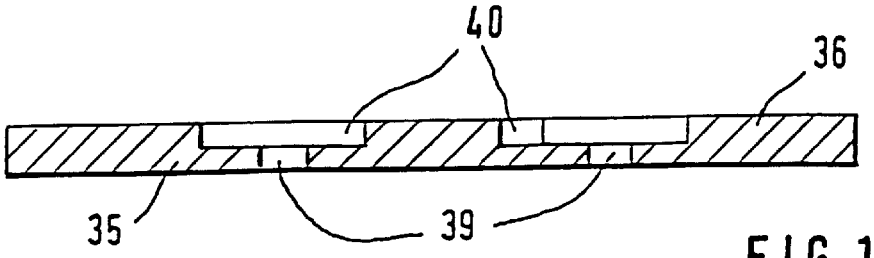
FIG. 12 shows the orifice plate in a section along the line XII—XII illustrated in FIG. 11.

The other exemplary embodiments of orifice plates 23 in FIGS. 7 to 12 have opening geometries of inlet regions 40 and of outlet orifices 39 which differ from the exemplary embodiment shown in FIGS. 5 and 6, to illustrate that different jet or spray patterns are attainable very easily as well. Besides the generation of a multi-jet or flat fan jet pattern (FIG. 5), an appropriate arrangement and formation of inlet regions 40 and outlet orifices 39 also make it possible at any time to generate a conical jet-spray discharge (FIGS. 7 and 8), asymmetrical jet patterns (FIGS. 9 and 10), as well as jet patterns experiencing angular momentum swirl (FIGS. 11 and 12). For example, orifice plate 23 according to FIGS. 7 and 8 has four circular inlet regions 40 which are arranged in a largely uniform manner about the center of orifice plate 23 and are also identical in size. Starting in each case from one circular inlet region 40, one outlet orifice 39, which in the exemplary embodiment shown again has a quadratic cross-section, in each case runs through lower functional level 35. Other cross-sectional shapes (e.g. circular, oval, multi-sided) are able to be formed at any time with the assistance of micro-galvanic metal deposition, depending on the desired spray pattern. For example, outlet orifices 39 do not extend starting from the center of inlet regions 40 to lower end face 38 of orifice plate 23, but rather, viewed clockwise in the top view onto orifice plate 23, are formed behind the respective centers of inlet regions 40. This is especially clear in FIG. 8, which shows orifice plate 23 as a section along a line VIII—VIII in FIG. 7.

Shown in FIGS. 9 and 10 is an orifice plate 23, by which an asymmetrical jet pattern can be generated. For special application purposes such as an unusual fitting position of the injector at the internal combustion engine, not only is a conical jet or a fan jet emerging from orifice plate 23 desirable, but also a spray-off of the fuel at a predetermined angle to longitudinal valve axis 2 (FIGS. 1 and 3). An orifice plate 23 according to FIGS. 9 and 10 makes this possible. Orifice plate 23 has three oval or egg-shaped inlet regions 40 in upper functional plane 36, and three, for example, quadratic outlet orifices 39 formed in lower functional plane 35. In each case, one inlet region 40 forms with, in each case, one outlet orifice 39, a functional unit having a complete axial passage for the fuel. The three inlet regions 40 are distributed asymmetrically in the shape of a triangle over perforated-disk surface 23, the three outlet orifices 39 likewise representing eccentric outlets from inlet regions 40. Such an orifice plate 23, having a jet pattern which can be generated asymmetrically, can be used in particular in "inclined-jet valves". Thus, even under unfavorable installation conditions, a very well-directed spray-discharge, e.g., onto an injector of an internal combustion engine is assured without wetting the walls of an intake manifold. FIG. 10 is a sectional view along a line X—X in FIG. 9.

FIGS. 11 and 12 show another exemplary embodiment of an orifice plate 23, FIG. 12 being a sectional view along a line XII—XII in FIG. 11. In this orifice plate 23, the four inlet regions 40, for example, are designed in such a way that a swirl component is superimposed on the fuel flowing through them. Depending on the way of looking at them, inlet regions 40 are shaped like a six or a nine, tangential arms 44, projecting from approximately circular regions 43 and pointing largely clockwise, being aligned toward the center of orifice plate 23, i.e., ultimately toward longitudinal valve axis 2. Illustratively, valve-seat member 16 overlaps inlet regions 40, such that the fuel coming from outlet 31 can only enter into tangential arms 44, from where it can flow into circular regions 43 of inlet regions 40 and enter into outlet orifices 39 which have circular cross-sections and are located in the middle of regions 43. The swirl-affected fuel leaves orifice plate 23 via outlet orifices 39. The swirl acting upon the fuel represents a measure which particularly promotes atomization of the fuel. Similar to inlet regions 40 shaped like sixes or nines, differently shaped, swirl-generating inlet regions 40, such as spiral-shaped, crescent-shaped or circular, can also be provided in their place.

What is claimed is:

1. A fuel injector for a fuel-injection system of an internal combustion engine, the fuel injector comprising:

a valve-seat member having a fixed valve seat and a lower end face;

a valve-closure member cooperating with the valve-seat member and being axially movable along a longitudinal valve axis of the fuel injector; and an orifice plate situated downstream from the valve-seat member, the orifice plate having an upper functional plane and a lower functional plane, the upper functional plane having a plurality of inlet openings and a first cross-sectional orifice geometry, the lower functional plane having a plurality of outlet orifices and a second cross-sectional orifice geometry, the first cross-sectional orifice geometry being different from the second cross-sectional orifice geometry, wherein a number of the inlet openings is equal to a number of the outlet orifices, wherein only one of the outlet orifices emanates from each of the inlet openings, and wherein each of the inlet openings is partially and directly covered by the lower end face of the valve-seat member for overlapping the outlet orifices with the valve-seat member.

2. The fuel injector according to claim 1, wherein the upper and lower functional planes are built up on one another by a galvanic metal deposition process.

3. The fuel injector according to claim 1, wherein each of the inlet openings has a first cross-section, and each of the outlet orifices has a second cross-section, and wherein the first cross-section is larger than the second cross-section.

4. The fuel injector according to claim 3, wherein none of the outlet orifices is overlapped by a wall of an inlet opening.

5. The fuel injector according to claim 1, wherein the second cross-sectional orifice geometry of the outlet orifices includes one of a quadratic cross-section geometry, a rectangular cross-section geometry, a multi-angular cross-section geometry, a circular cross-section geometry and an oval cross-section geometry.

6. The fuel injector according to claim 1, wherein the inlet openings are arranged on a surface of the orifice plate to generate one of a conical pattern, a flat fan pattern, a multi-jet pattern and an asymmetrical jet pattern.

7. The fuel injector according to claim 1, wherein the inlet openings receive a fuel to generate an angular momentum swirl.

8. The fuel injector according to claim 1, further comprising:

an orifice-plate support member securing the orifice plate to the valve-seat member.

9. The fuel injector according to claim 1, the inlet openings have a shape selected from the group consisting of a six shape and a nine shape.

* * * * *